US010362907B2

(12) United States Patent
Holleron

(10) Patent No.: US 10,362,907 B2
(45) Date of Patent: Jul. 30, 2019

(54) SOLID SOAP HOLDER

(71) Applicant: Shaun Holleron, Wigan (GB)

(72) Inventor: Shaun Holleron, Wigan (GB)

( * ) Notice: Subject to any disclaimer, the term of this patent is extended or adjusted under 35 U.S.C. 154(b) by 0 days.

(21) Appl. No.: 16/051,622

(22) Filed: Aug. 1, 2018

(65) Prior Publication Data

US 2019/0038087 A1 Feb. 7, 2019

(30) Foreign Application Priority Data

Aug. 2, 2017 (GB) ..... 1712409.0

(51) Int. Cl.

| | |
|---|---|
| ***A47K 5/05*** | (2006.01) |
| ***A45F 5/00*** | (2006.01) |
| *A44C 5/00* | (2006.01) |
| *A44C 15/00* | (2006.01) |

(52) U.S. Cl.

CPC ..... *A47K 5/05* (2013.01); *A44C 5/0007* (2013.01); *A44C 15/0025* (2013.01); *A45F 2005/008* (2013.01)

(58) Field of Classification Search

CPC ..... A47K 5/04; A47K 5/05; A47K 5/1201; A44C 5/0007; A44C 15/0025; A45F 2005/008

USPC ..... 224/148.1, 148.6, 217, 218, 219, 221; 2/160

See application file for complete search history.

(56) References Cited

U.S. PATENT DOCUMENTS 1,139,942 A * 5/1915 Wightman ..... B43M 11/04 118/201
1,325,607 A * 12/1919 Barber ..... 150/150
2,771,224 A * 11/1956 Boerger ..... A47K 5/1201 222/210
3,341,457 A * 9/1967 Schmidt ..... A47K 5/05 248/682
3,346,152 A * 10/1967 Geisendorff ..... A47K 5/04 224/664
5,011,316 A * 4/1991 Damon ..... A47K 5/05 248/206.3
5,222,643 A * 6/1993 Platt ..... A45D 34/04 220/695
5,390,971 A * 2/1995 Warren ..... A47K 5/05 294/165

(Continued)

OTHER PUBLICATIONS

British Search Report received in GB1712409.0, dated Jan. 19, 2018, pp. 3.

(Continued)

*Primary Examiner* — Justin M Larson

(74) *Attorney, Agent, or Firm* — The Patent Shoppe; Patrick Lavender

(57) ABSTRACT

A soap holder 10 comprises a reversible elastic wristband having a dual-sided face 20. A first side of the face 20 has an indentation 30 for receiving a piece of solid soap. A second side of the face is provided with a waterproof watch or other functional device, or a decorative surface. In normal wear, the soap holder 10 is worn on the wrist of a user with the second side facing outwards. When the user wishes to wash, the wristband is reversed so that the first side faces outwards. The face 20 is moved to the palm of the user. A piece of soap is pressed into the indentation 30 and the user is conveniently able to wash themselves.

8 Claims, 2 Drawing Sheets

(56) References Cited

U.S. PATENT DOCUMENTS 5,732,862 A * 3/1998 Bull ..... A61C 19/006 206/63.5
6,998,373 B1 * 2/2006 Faines, Jr. ..... A47K 5/08 15/208
8,474,668 B2 * 7/2013 Toman ..... A45F 5/00 224/219
9,516,930 B2 * 12/2016 Izkovitz ..... A44C 9/0069
9,578,935 B2 * 2/2017 Horgan ..... A45D 34/00
D834,855 S * 12/2018 Gould ..... D6/536
10,264,859 B2 * 4/2019 Parker ..... A44C 9/0069
2002/0090423 A1 * 7/2002 Shecter ..... A23G 3/563 426/104
2011/0052305 A1 * 3/2011 Leros ..... A47K 5/1201 401/137
2011/0155765 A1 * 6/2011 Properzi ..... A47K 5/1201 222/175
2012/0081852 A1 * 4/2012 Maravilla ..... A45F 5/00 361/679.03
2013/0020367 A1 * 1/2013 Buckley ..... A63B 57/353 224/584
2013/0125321 A1 * 5/2013 Newbould ..... A47K 5/05 15/104.001
2013/0206801 A1 * 8/2013 Delgatty ..... A45F 5/00 224/219
2014/0117060 A1 * 5/2014 Colone ..... A44C 5/003 224/219
2015/0158042 A1 * 6/2015 Parker ..... B05B 11/048 222/175
2015/0282677 A1 * 10/2015 Gould ..... A47K 5/05 510/152
2015/0359321 A1 * 12/2015 Wu ..... G09F 3/005 224/219
2016/0143315 A1 * 5/2016 Schuricht ..... A44C 15/003 426/135
2017/0216519 A1 * 8/2017 Vouillamoz ..... A44C 15/002
2019/0038087 A1 * 2/2019 Holleron ..... A47K 5/05

OTHER PUBLICATIONS

YouTube video "Yuchooze revised version" created by the inventor and published May 21, 2017 * Available at https://www.youtube.com/watch?v=c3-KEbGtsNU.

* cited by examiner

SOLID SOAP HOLDER

RELATED APPLICATIONS

This application claims the benefit under 35 U.S.C. § 119(a) of a patent application filed on Aug. 2, 2017 in the Intellectual Property Office of the United Kingdom and assigned serial number GB1712409.0, the contents of which is incorporated by reference in its entirety.

BACKGROUND OF THE INVENTION

The present invention relates to a device adapted to be worn on the wrist and to hold a block of solid soap during washing.

SUMMARY OF THE INVENTION

Cleanliness and good hygiene are important both socially and professionally. Many soap products are available and the convenience of liquid soaps has made them very popular. However, liquid soaps require bulky packaging such as a plastic bottle. Disposal of single use plastic bottles after the contents are exhausted is an environmental problem. Solid soaps are less convenient but require less packaging, making them a better choice environmentally. Making solid soaps more convenient to use to increase their popularity would have a positive environmental impact.

One device for making solid soap more convenient is described in U.S. Pat. No. 6,998,373. A soap retaining pouch made from a polyester mesh is connected to an elastic band. The elastic band extends around the hand of a user to prevent the pouch from slipping out of the user's hand and permitting the user to easily apply soap to their body.

The present invention provides a soap holder comprising an elastic wristband, the wristband having a face having a first side and a second side, the first side of the face having an indentation for receiving a piece of solid soap, a plurality of prongs being provided inside the indentation for retaining a piece of soap pressed into the indentation, the wristband being reversible so that either one of the first side or the second side faces outwards.

Advantageously, embodiments of the present invention provide a device which can be worn on the wrist and is therefore available for holding a solid piece of soap when the user wishes to wash. The wristband is reversible during normal wear to hide the indentation which receives the soap. The prongs provide a simple and effective way of holding the soap in place while the user washes.

Preferably, the soap holder is normally worn on the wrist of a user with the second side facing outwards. The second side can provide an alternative function such as a watch or similar device.

In one arrangement, the prongs are attached to an insert which is moulded inside the soap holder with the prongs protruding through the surface. This provides an effective way of securing the prongs in place.

In another arrangement, the prongs are attached to a spoked insert which is secured inside the indentation. Preferably, the tip of each spoke is barbed. This alternative provides a simple way of securing the prongs to the wristband.

BRIEF DESCRIPTION OF THE DRAWINGS

Preferred embodiments of the invention will now be described with reference to the accompanying drawings in which.

DETAILED DESCRIPTION OF THE INVENTION

Figure 1:
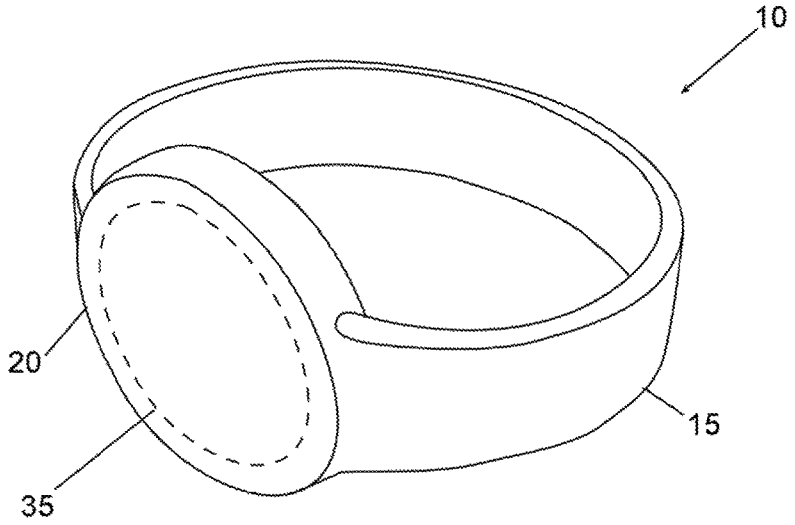
FIG. 1 illustrates a first view of a wristband soap holder.
Figure 2:
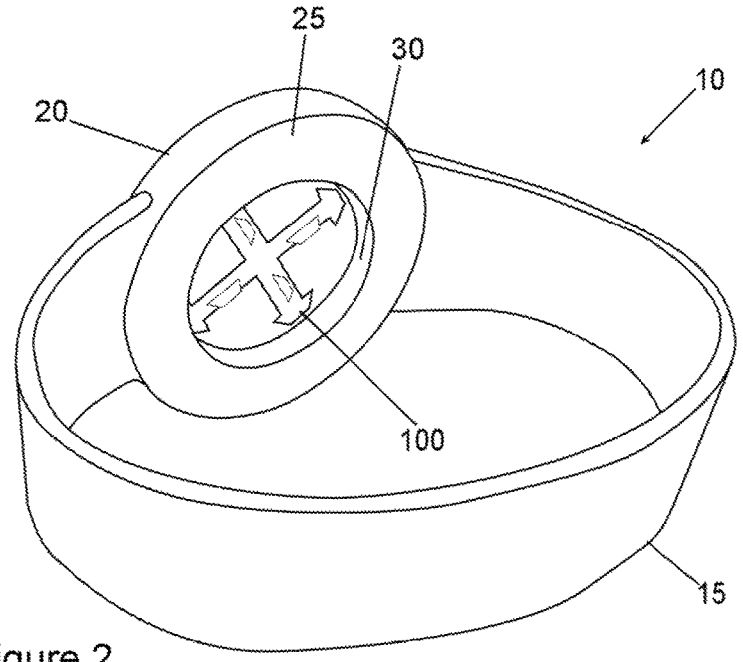
FIG. 2 illustrates a second view of the wristband soap holder.

FIGS. 1 and 2 illustrate a soap holder 10 embodying the present invention. The soap holder 10 comprises a band 15 and a face 20, together forming a wristband. The band 15 is adapted to go around the wrist of a user so that the soap holder 10 can be worn around the wrist when the user is not washing. The face 20 has a dual purpose, being adapted both to hold a piece of solid soap 200 and to provide an alternative function and/or fashionable appearance. In this way, a user is encouraged to wear the soap holder 10 at all times.

The wristband is formed from any suitable waterproof material such as rubber or silicone. Preferably, the wristband is formed or moulded as a single, endless piece and is sufficiently elastic to conform comfortably to a user's wrist. Optionally, the band 15 instead has two ends and is adjustable to fit the user's wrist.

The face 20 is preferably shaped as a circular disc having a diameter of between 2 cm and 4 cm and a thickness of approximately 1 cm. Although a circular disc is preferred for simplicity of design, the outline of the face may be any shape if greater visual impact is desired.

The face 20 has first and second opposing sides. The first side 25 has an indentation 30 of between 4 mm and 5 mm in depth for receiving a piece of soap 200. The indentation 30 preferably has a circular outline with a diameter of between 2 cm and 3 cm. The second side 35 provides an alternative function and/or a fashionable appearance and is marked with a dotted outline in FIG. 1 to indicate the wide range of options that may be implemented.

In one implementation, the second side 35 is patterned/coloured and/or textured to provide a visually striking and fashionable appearance. In this implementation, the alternative function of the second side 35 is to be decorative. The soap holder 10 can therefore be worn day-to-day as a simple fashion statement.

In another implementation, the second side 35 is provided with any suitable waterproof mechanical or electronic device such as a watch, timer, stopwatch or computing device. In this implementation, the second side 35 provides additional useful functionality, increasing its value to the user. As just one example: in a medical environment, the second side 35 may be provided with a stopwatch or timer to measure how long it has been since the user last washed their hands, or to ensure they wash their hands for a sufficient amount of time.

In normal wear, the soap holder 10 is arranged on the user's wrist with the second side 35 facing outwards. When the user wishes to wash, the wristband is reversed so that the face 20 is flipped over and the first side 25 faces outwards. Since the wristband is made from an elastic material, reversing it is a straightforward operation and can be achieved even without removing the soap holder 10 from the wrist.

The soap holder 10 is then moved onto the user's hand, with the face located in the user's palm for ease of holding and manipulation. A piece of soap 200 is placed into the indentation 30 in the first side 25 of the face 20. The user then washes themselves using the soap 200, an action which is simplified because the soap holder 10 makes holding and applying the soap 200 to the body easier. When the user has finished washing, the soap 200 is removed from the indentation 30. The soap holder 10 is cleaned and dried if desired and is then reversed and moved back to the wrist with the second side 35 facing outwards.

The indentation 30 in the face 20 may be shaped so that a suitably shaped piece of soap 200 fits snugly inside and is held in place without additional holding means. For example, the rim of the indentation 30 may extend over the hole a small distance to prevent the soap 200 from falling out. Preferably, however, the interior of the indentation 30 is provided with soap retaining prongs 130,170. In use, the soap 200 is pressed onto the prongs 130,170 and the prongs 130,170 penetrate the soap 200 and hold it in place within the indentation 30.

The prongs 130,170 are preferably formed from a hard, plastics material. Any suitable arrangement of prongs 130, 170 may be used and may be secured to the interior of the indentation 30 in any suitable way. For example, the prongs may be moulded into the wristband or may be adhered to the wristband after moulding.

Figure 3:
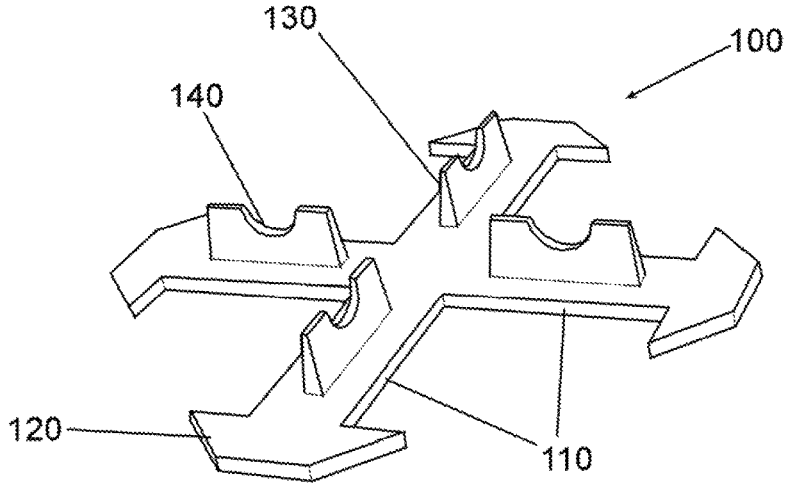
FIG. 3 illustrates an insert having soap retaining prongs.

In one arrangement, illustrated in FIG. 3, an insert 100 having a set of prongs is made as a single piece. The insert 100 comprises a plurality of spokes 110 with a barb 120 at the end of each spoke 110. Preferably there are three or four spokes 110. The insert 100 is pushed into the indentation 30 and the barbs 120 press into the elastic walls of the indentation 30 which secures the insert 100 in place.

Each spoke 110 is provided with a prong comprising an elongate blade 130 extending away from the spoke. Each blade has a narrow top edge, widening at the base where the blade 130 connects to the spoke 110. The top edge of each blade 130 penetrates the soap 200 in use and holds the soap 200 in place inside the indentation 30. The top edge of each blade 130 has a curved indentation 140 to create a suctioning effect between the blade 130 and the soap 200.

Figure 4:
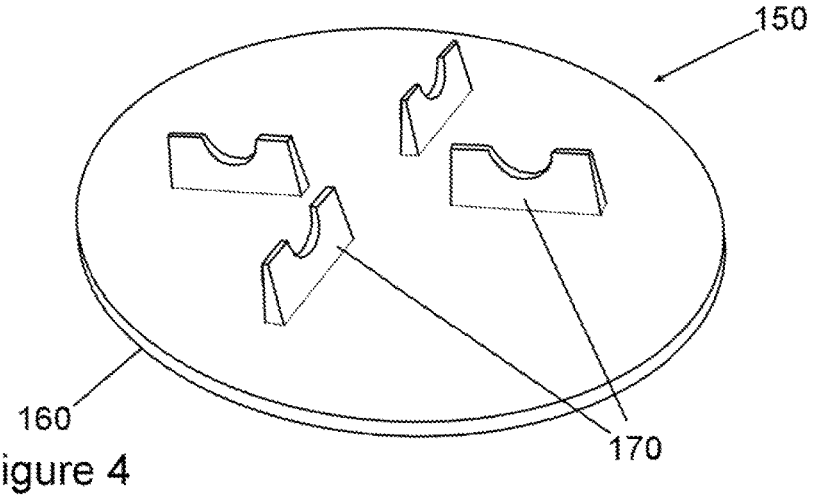
FIG. 4 illustrates an alternative insert.

An alternative insert 150 is illustrated in FIG. 4. The insert 150 comprise a flat base 160 and a plurality of blades 170 extending away from the base 160. This alternative insert 150 is intended to be moulded in place inside the face 20, with the blades 170 protruding through the surface at the bottom of the indentation 30. The blades 170 are preferably arranged in a spoke pattern on the base 160 but may have any suitable arrangement. The base 160 preferably has a circular outline, but may have any wide, flat shape to ensure that the insert 150 is securely located inside the face 20 and will not tear the material of the wristband.

Cylindrical spikes may be used instead of blades 130, 170 if desired, but blades secure the soap 200 better and are less likely to break in use.

Figure 5:
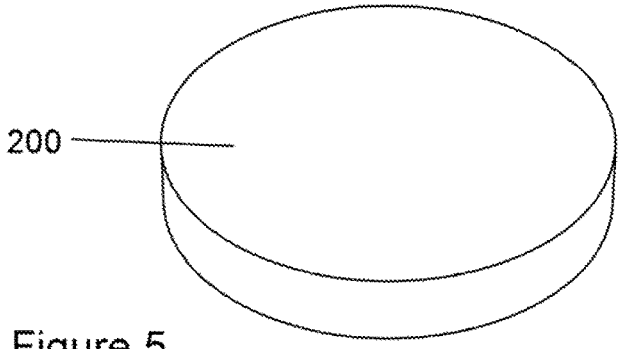
FIG. 5 illustrates a block of soap.

FIG. 5 illustrates a block of solid soap 200 that may be used with embodiments of the present invention. Preferably, the soap 200 is a disc with a circular outline so that it can be pressed into the circular indentation 30 in any orientation. Different shapes of soap 200 may be used if desired and a different shape of indentation 30 may be moulded into the face 20 depending on the soap 200 intended for use.

The soap 200 preferably has a diameter of between 2 cm and 3 cm and a thickness of between 10 mm and 12 mm. When inserted into the indentation 30, the soap therefore protrudes by between approximately 5 mm and 7 mm. This ensures that there is a good surface area of soap available for use in washing.

Any suitable solid soap may be used. Preferably, however, the soap is a multi-purpose soap comprising bodywash, shampoo and hair conditioner that can be used for washing the hair and the body.

The preceding description of the invention is presented by way of example. The best mode known to the inventor for implementing the invention is described by referring to numerous preferred features. It will nevertheless be understood that various changes (including modifications and the use of alternatives and equivalents) can be made without departing from the spirit and scope of the invention.

What is claimed is:

1. A soap holder comprising an elastic wristband, the wristband having a face having a first side and a second side, the first side of the face having an indentation for receiving a piece of solid soap, a plurality of prongs being provided inside the indentation for penetrating and retaining a piece of soap pressed into the indentation, the wristband being reversible so that either one of the first side or the second side faces outwards.

2. The soap holder of claim 1 wherein the soap holder is normally worn on the wrist of a user with the second side facing outwards and wherein the second side comprises a waterproof watch.

3. The soap holder of claim 1 wherein each prong comprises an elongate blade.

4. The soap holder of claim 3 wherein a top edge of each blade has a curved indentation.

5. The soap holder of claim 1 wherein the prongs are attached to an insert having a plurality of spokes, the insert being secured inside the indentation.

6. The soap holder of claim 5, wherein the tip of each spoke is barbed.

7. The soap holder of claim 1 wherein the prongs are attached to an insert which is moulded inside the soap holder with the prongs protruding through the surface.

8. The soap holder of claim 1 wherein the prongs are formed from a hard plastics material.

* * * * *